US008871307B2

(12) United States Patent
Suzuki

(10) Patent No.: US 8,871,307 B2
(45) Date of Patent: Oct. 28, 2014

(54) METHOD FOR MANUFACTURING CYLINDRICAL MEMBER

(71) Applicant: Canon Kabushiki Kaisha, Tokyo (JP)

(72) Inventor: Takeshi Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 197 days.

(21) Appl. No.: 13/688,900

(22) Filed: Nov. 29, 2012

(65) Prior Publication Data

US 2013/0142961 A1 Jun. 6, 2013

(30) Foreign Application Priority Data

Dec. 6, 2011 (JP) ..... 2011-266881
Nov. 14, 2012 (JP) ..... 2012-250520

(51) Int. Cl.

| | |
|---|---|
| ***B05D 1/26*** | (2006.01) |
| ***B05D 1/18*** | (2006.01) |
| ***B05C 5/02*** | (2006.01) |
| *B05D 1/00* | (2006.01) |

(52) U.S. Cl.

CPC .. *B05D 1/18* (2013.01); *B05D 1/26* (2013.01); *B05D 1/002* (2013.01); *B05C 5/0241* (2013.01); *Y10S 118/11* (2013.01)

USPC ..... 427/430.1; 118/DIG. 11; 118/500; 118/70; 118/428

(58) Field of Classification Search

None

See application file for complete search history.

(56) References Cited

U.S. PATENT DOCUMENTS

| | | | | |
|---|---|---|---|---|
| 2,740,480 | A * | 4/1956 | Cox | 166/170 |
| 4,420,548 | A | 12/1983 | Sakai et al. | |
| 7,693,457 | B2 | 4/2010 | Kuruma et al. | |
| 7,962,068 | B2 | 6/2011 | Kuroda et al. | |
| 8,064,803 | B2 | 11/2011 | Kuroda et al. | |
| 2004/0213913 | A1 * | 10/2004 | Jung et al. | 427/420 |
| 2011/0233803 | A1 | 9/2011 | Hara | |
| 2012/0045250 | A1 | 2/2012 | Harada et al. | |
| 2012/0076539 | A1 | 3/2012 | Sato et al. | |

FOREIGN PATENT DOCUMENTS

| | | | |
|---|---|---|---|
| JP | 10-272401 | A | 10/1998 |
| JP | 2004-330089 | A | 11/2004 |
| JP | 2007-130589 | A | 5/2007 |

OTHER PUBLICATIONS

Chinese Office Action dated Dec. 25, 2013 in Chinese Application No. 201210517830.2.

* cited by examiner

*Primary Examiner* — David Turocy

(74) *Attorney, Agent, or Firm* — Fitzpatrick, Cella, Harper and Scinto

(57) ABSTRACT

The present invention has an object to provide a method for manufacturing a plurality of high quality cylindrical members. The method includes: vertically holding a mandrel so as to be coaxial with a central axis of an annular slit; and discharging a liquid coating through the slit to form a film of the coating on a surface of the mandrel while vertically moving up the mandrel. A circular cleaning blade is rotatably mounted around a lower holding shaft. The step includes the steps of: (1) forming a film of the coating up to a lower end of a coating region of the mandrel, and then stopping the discharge; and (2) moving up the lower holding shaft so that the cleaning blade passes through the annular slit to clean it, in this order. Then the cleaning blade is rotated to clean the cleaning blade.

9 Claims, 14 Drawing Sheets

METHOD FOR MANUFACTURING CYLINDRICAL MEMBER

BACKGROUND OF THE INVENTION

1. Field of the Invention

The present invention relates to a method for manufacturing a cylindrical member having a coating on an outer peripheral surface of a mandrel using a ring-shaped coating head.

2. Description of the Related Art

In a known method for manufacturing a cylindrical member having a coating on a peripheral surface of a mandrel, a coating liquid is applied on an outer periphery of the mandrel using a ring-shaped coating head having an annular slit opening in an inner peripheral surface (see Japanese Patent Application Laid-Open No. 2007-130589). Such a method for manufacturing a cylindrical member is applied to, for example, manufacture of an elastic roller which can favorably be used in an electrophotographic apparatus having an elastic layer containing silicone rubber on a peripheral surface of a mandrel.

After application of a coating liquid to a peripheral surface of one mandrel, discharge of the coating liquid from a ring-shaped coating head needs to be temporarily stopped in order to place a next mandrel on the ring-shaped coating head. As one problem of the above described method, when an annular slit is being separated from the coated mandrel, the coating liquid is stretched over both the slit and the coated mandrel, and the coating liquid adheres to and remains on around the slit.

Thus, in an intermittent application of the coating liquid with the ring-shaped coating head as described above, a coating liquid adhered to and remained on a slit portion of a coating head, needs to be removed before start or after finish of application of the coating liquid.

Japanese Patent Application Laid-Open No. 2007-130589 discloses a method for cleaning the annular slit. In this method, a detachable ring member is attached to the slit portion of the ring-shaped coating head, and, after application, the ring member is moved perpendicularly to a surface in which the annular slit opens, that is, the inner peripheral surface of the ring-shaped coating head. Thus, a coating liquid remained on the annular slit portion is adhered to the ring member. The ring member is taken out to clean the annular slit.

However, in the method described in Japanese Patent Application Laid-Open No. 2007-130589, the detachable ring member is taken out from a coating device together with the coated mandrel, and thus the ring member needs to be changed for each application. Thus, one application to the mandrel requires one ring member. Also, a mechanism for attaching and detaching the ring member to and from a coating device body is required.

SUMMARY OF THE INVENTION

Therefore, the present invention is directed to providing a method for manufacturing cylindrical member more efficiently.

According to one aspect of the present invention, there is provided a method for manufacturing a cylindrical member which comprises a mandrel and a coating formed on the peripheral surface thereof, the method comprising a step of: vertically or substantially vertically holding a mandrel between an upper holding shaft and a lower holding shaft so as to be coaxial with a central axis of a ring-shaped coating head having an annular slit opening in an inner peripheral surface, and discharging a coating liquid through the annular slit while vertically or substantially vertically moving up the mandrel with respect to the ring-shaped coating head to form the coating on an outer peripheral surface of the mandrel, wherein a circular cleaning blade is rotatably mounted around the lower holding shaft, the step includes the steps of: (1) forming the coating of the coating liquid up to a lower end of a coating region on the outer peripheral surface of the mandrel, and then stopping discharge of the coating liquid through the annular slit; (2) moving up the lower holding shaft with respect to the ring-shaped coating head so that the cleaning blade passes through the annular slit to clean the annular slit; and (3) moving down the lower holding shaft with respect to the ring-shaped coating head so that the cleaning blade passes through the annular slit to clean the annular slit, in this order, and the method further includes a step of rotating the cleaning blade around the lower holding shaft to clean the cleaning blade after at least one of the steps (2) and (3).

According to another aspect of the present invention, there is provided a method for manufacturing a cylindrical member which comprises a mandrel and a coating formed on a peripheral surface thereof, the method comprising a step of: vertically or substantially vertically holding a mandrel with an upper holding shaft and a lower holding shaft so as to be coaxial with a central axis of a ring-shaped coating head having an annular slit opening in an inner peripheral surface, and discharging a coating liquid through the annular slit while vertically or substantially vertically moving up the mandrel with respect to the ring-shaped coating head to form a coating of the coating liquid on an outer peripheral surface of the mandrel, wherein a circular cleaning blade is rotatably mounted around the lower holding shaft, wherein the step includes the steps of: (1) forming the coating of the coating liquid up to a lower end of a coating region on the outer peripheral surface of the mandrel, and then stopping discharge of the coating liquid through the annular slit; and (2) moving up the lower holding shaft with respect to the ring-shaped coating head so that the cleaning blade passes through the annular slit to clean the annular slit; in this order, and wherein the method further comprises a step of rotating the cleaning blade around the lower holding shaft to clean the cleaning blade after the step (2).

Further features of the present invention will become apparent from the following description of exemplary embodiments with reference to the attached drawings.

DESCRIPTION OF THE EMBODIMENTS

Figure 1:
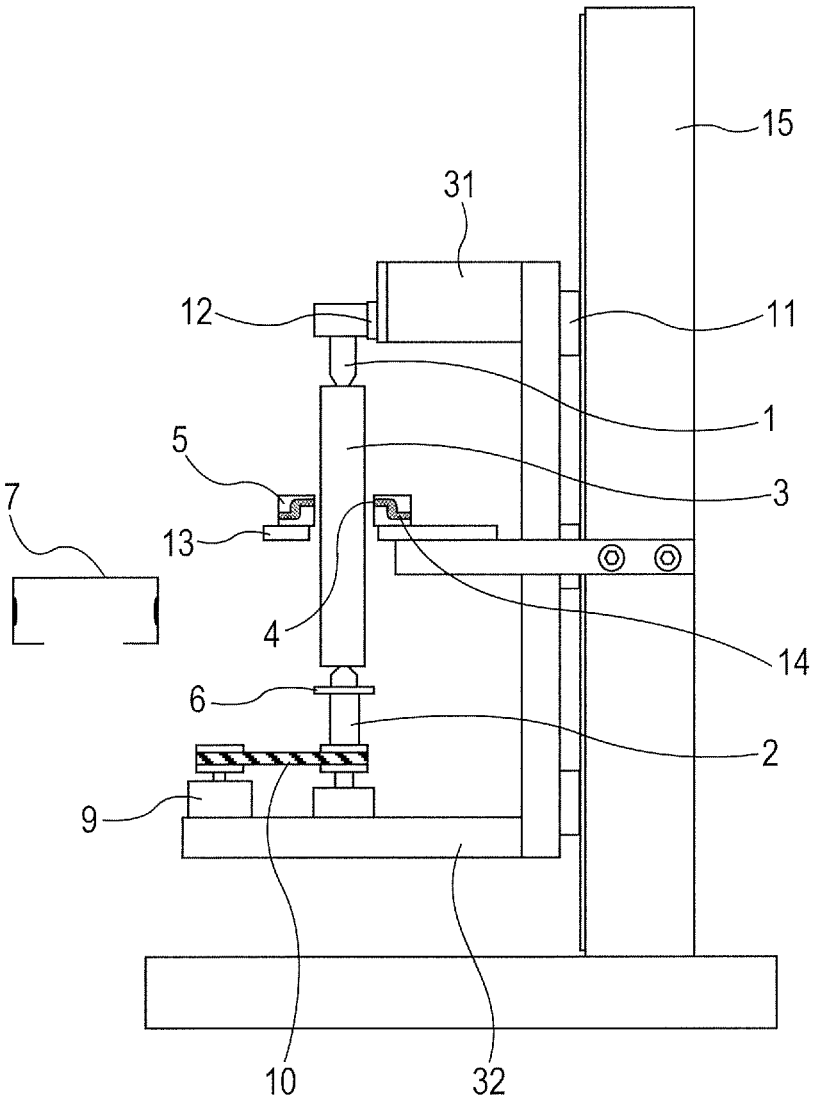
FIG. 1 is a schematic configuration diagram of an embodiment of a coating device according to the present invention.

Preferred embodiments of the present invention will now be described in detail in accordance with the accompanying drawings.

With reference to the accompanying drawings, embodiments of the present invention will be described in detail. In the accompanying drawings, components having the same functions are denoted by the same reference numerals, and descriptions thereof will be sometimes omitted.

FIG. 1 is a schematic configuration diagram of an embodiment of a coating device according to the present invention, used for manufacturing a cylindrical member such as an elastic roller used in an electrophotographic apparatus.

In order to describe a flow of a coating liquid 14 to be applied from an annular slit 4 in a ring-shaped coating head 5 to an outer peripheral surface of a mandrel 3 as a base material, the ring-shaped coating head 5 and a coating head stage 13 supporting the ring-shaped coating head 5 are illustrated as a schematic sectional view.

The coating device 15 includes a mandrel slide mechanism 11 having an upper support portion 31 and a lower support base 32 facing the upper support portion 31. An upper holding shaft 1 of the mandrel 3 is provided on the upper support portion 31 via an upper holding shaft slide portion 12. A lower holding shaft 2 which holds the mandrel 3 and a rotary drive source 9 are provided on the lower support base 32. The upper holding shaft 1 and the lower holding shaft 2 are located on the same axis extending vertically or substantially vertically.

The mandrel slide mechanism 11 is vertically or substantially vertically slidable, and a spacing between the upper support portion 31 and the lower support base 32 does not vary. In the present invention, "substantially vertical" refers to a tilt of the mandrel in a longitudinal direction with respect to a direction of gravitation force being larger than 0° and equal to or smaller than 5°.

The mandrel 3 to be coated is supported, at upper and lower ends, by the upper holding shaft 1 and the lower holding shaft 2, respectively. A position adjustment mechanism (not shown) adjusts the mandrel 3 so that an axis is vertically or substantially vertically held.

A ring-shaped coating head 5 having an annular slit 4 in an inner peripheral surface is placed on the coating head stage 13. The ring-shaped coating head 5 is adjusted and secured by the position adjustment mechanism (not shown) so that a central axis of the ring-shaped coating head 5 matches the axis of the mandrel 3. Thus, axes of the upper holding shaft 1, the lower holding shaft 2, and the mandrel 3, and the central axis of the ring-shaped coating head 5 match to one another.

The upper holding shaft 1 is vertically or substantially vertically moved by the upper holding shaft slide portion 12, a cylinder (not shown), a servomotor (not shown), or the like. The upper holding shaft 1 is moved down by the upper holding shaft slide portion 12 when holding the mandrel 3, and moved up by upper holding shaft slide portion 12 when taking out the mandrel 3 from the coating device 15.

The lower holding shaft 2 is rotatable and which is held perpendicularly or substantially perpendicularly to the lower support base 32. "Substantially perpendicularly" as used herein refers to that the lower holding shaft 2 forms an angle within a range of 90±5° with respect to the lower support base 32 (except a case of 90°).

The lower holding shaft 2 is associated with a rotation axis of a rotary drive source 9 and a rotation transmitting belt 10, and it is configured to be rotatable by rotation of the rotation axis. The lower holding shaft 2 can be smoothly rotated without axial runout.

A circular cleaning blade 6 is mounted to a lower part of the lower holding shaft 2 so as to be concentric with a center of rotation of the lower holding shaft 2. Thus, a position of the cleaning blade 6 is adjusted so that the lower holding shaft 2 is rotated without runout of an outer peripheral surface of the cleaning blade 6.

The lower holding shaft 2 and the cleaning blade 6 are adjusted to be coaxial with the central axis of the ring-shaped coating head 5 by the position adjustment mechanism (not shown).

Further, in order to rotate the lower holding shaft 2 at high speed, the rotation transmitting belt 10 configured to transmit rotation from the rotary drive source 9 provided on the lower support base 32 is mounted below the cleaning blade 6. When the rotary drive source 9 is rotated, the rotation transmitting belt 10 smoothly rotates the lower holding shaft 2 without axial runout.

Further, rotation of the lower holding shaft 2 causes rotation of the cleaning blade 6, and a mechanism is configured in which the coating liquid 14 which is collected from the annular slit 4 of the ring-shaped coating head 5 onto the cleaning blade 6 is blown off by a centrifugal force generated during high speed rotation.

Further, a collection container 7 for efficiently collecting the coating liquid 14 blown off from the cleaning blade 6 by the centrifugal force generated during high speed rotation is provided in the coating device 15.

The collection container 7 has a box shape or a cylindrical shape, and it has, in a lower part, an opening through which the cleaning blade 6 is inserted. A flange-like disk member for preventing dispersion of the coating liquid 14 is provided around the opening. An inner surface of the collection container 7 is coated with fluororesin or the like and subjected to releasing treatment of the coating liquid.

The collection container 7 is movable by a movement mechanism (not shown), and when not used, the collection container 7 stands by in a position where the collection container 7 does not interfere with attachment or detachment of the mandrel 3 to or from the mandrel slide mechanism 11, or with a coating of the mandrel 3.

When the mandrel slide mechanism 11 is located in an uppermost position, the cleaning blade 6 is located above the ring-shaped coating head 5. When the mandrel slide mechanism 11 is located in a lowermost position, the cleaning blade 6 is located below the ring-shaped coating head 5.

When the mandrel 3 is held with the upper holding shaft 1 and the lower holding shaft 2 to be secured to the coating device 15, a cylinder and a valve of a coating liquid supply device (not shown), with the mandrel slide mechanism 11, move as a unit. Specifically, the cylinder and the valve of the coating liquid supply device (not shown) move in accordance with a movement speed of the mandrel slide mechanism 11, and the coating liquid 14 is discharged through the annular slit 4 in the ring-shaped coating head 5 onto the outer peripheral surface of the mandrel 3 so that desired coating is performed.

Embodiment 1

A first method for manufacturing a plurality of cylindrical members by coating the mandrel 3 using the coating device 15 in FIG. 1 will be described.

In this method, the collection container 7 is moved above the ring-shaped coating head 5. FIGS. 2A to 2I sequentially illustrate a series of operations including an application step of the coating to a first mandrel and a cleaning step, and then subsequent introduction of a second mandrel into the coating device 15 in this embodiment.

The mandrel slide mechanism 11 is moved to an upper end, and then the upper holding shaft 1 is moved up by the upper holding shaft slide portion 12, a cylinder (not shown), and a servomotor (not shown).

Figure 2B:
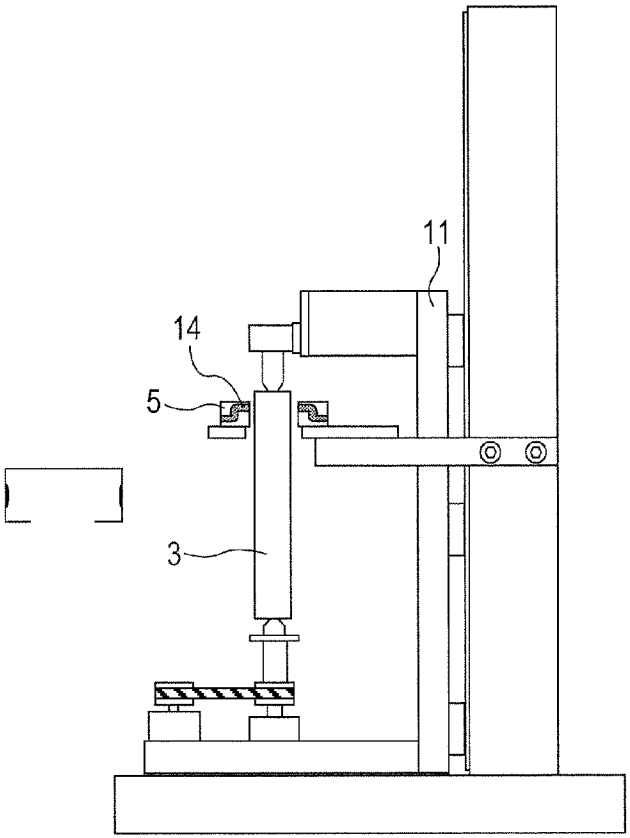
FIGS. 2A, 2B, 2C, 2D, 2E, 2F, 2G, 2H and 2I illustrate coating operations according to Embodiment 1.
Figure 2A:
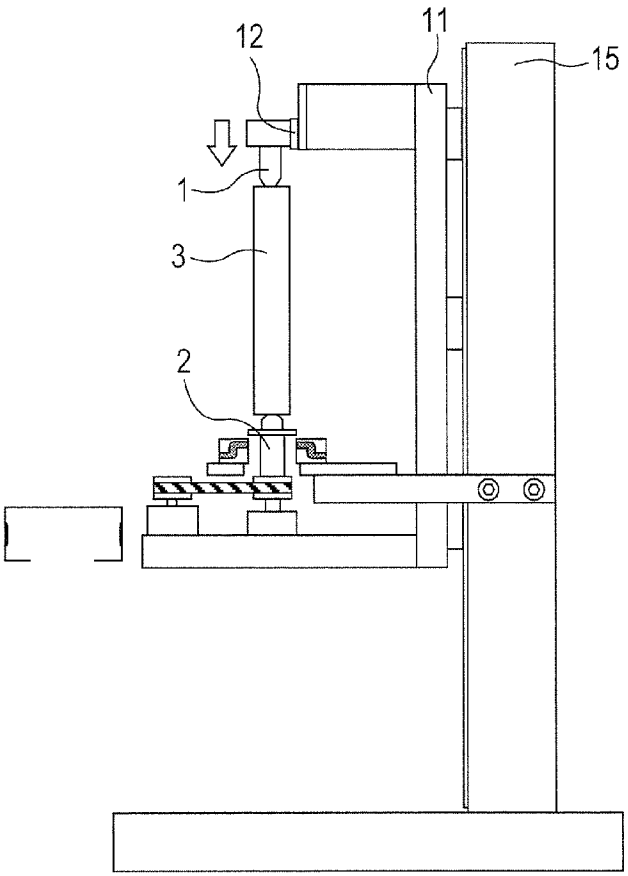

Then, a lower end of the mandrel 3 is held on the lower holding shaft 2 by an attachment and detachment mechanism (not shown), then the upper holding shaft 1 is moved down by the upper holding shaft slide portion 12, the cylinder (not shown), and the servomotor (not shown), and the mandrel 3 is held between the upper holding shaft 1 and the lower holding shaft 2 and secured to the coating device 15 (FIG. 2A).

The mandrel slide mechanism 11 is moved down to match a coating start position of the mandrel 3 with a discharge position of the coating liquid 14 of the ring-shaped coating head 5 (FIG. 2B).

Figure 2D:
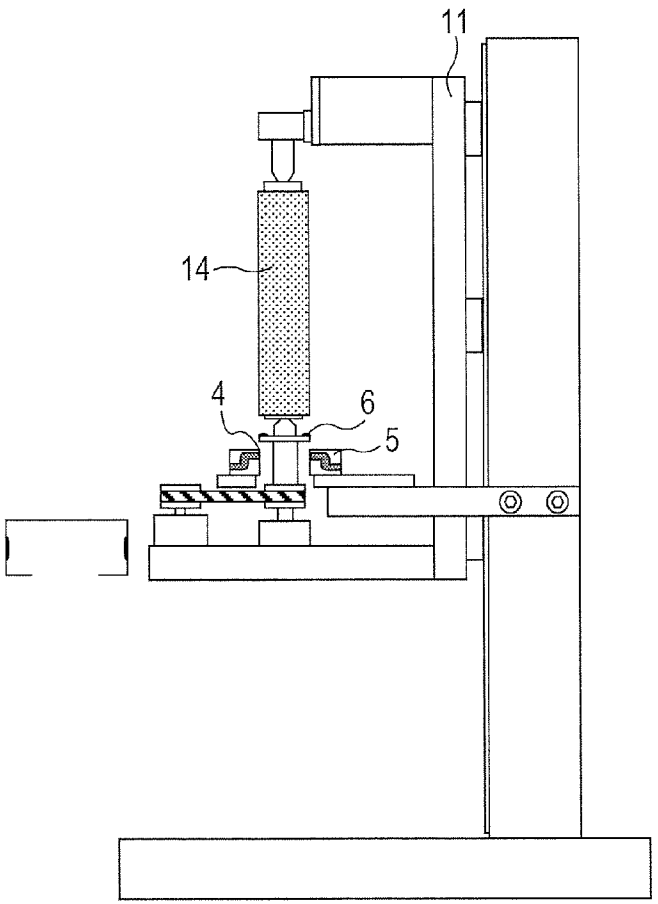
Figure 2C:
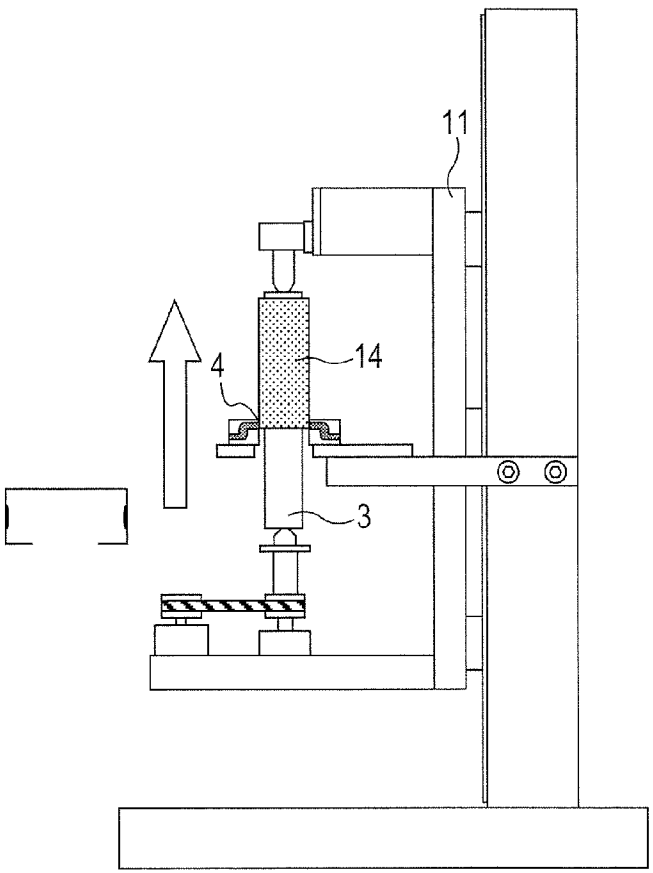

While the coating liquid 14 is discharged at a constant flow rate from the ring-shaped coating head 5 through the annular slit 4 toward the outer peripheral surface of the mandrel 3, the mandrel slide mechanism 11 is moved up at a constant speed, so that a coating having a constant thickness is formed on the outer peripheral surface of the mandrel 3 (FIG. 2C).

After the coating is formed up to a lower end of a coating region on the outer peripheral surface of the mandrel 3, discharge of the coating liquid 14 through the annular slit 4 is stopped. The mandrel slide mechanism 11 is further moved up to move the cleaning blade 6 above the ring-shaped coating head 5 (FIG. 2D). At this time, the cleaning blade 6 passes through a position of the annular slit 4, and thus the coating liquid 14 generated when the discharge of the coating liquid 14 is stopped and remaining on adhering to around the annular slit 4 can be scraped off by an upper surface of the cleaning blade 6 and transferred to the upper surface.

Figure 2F:
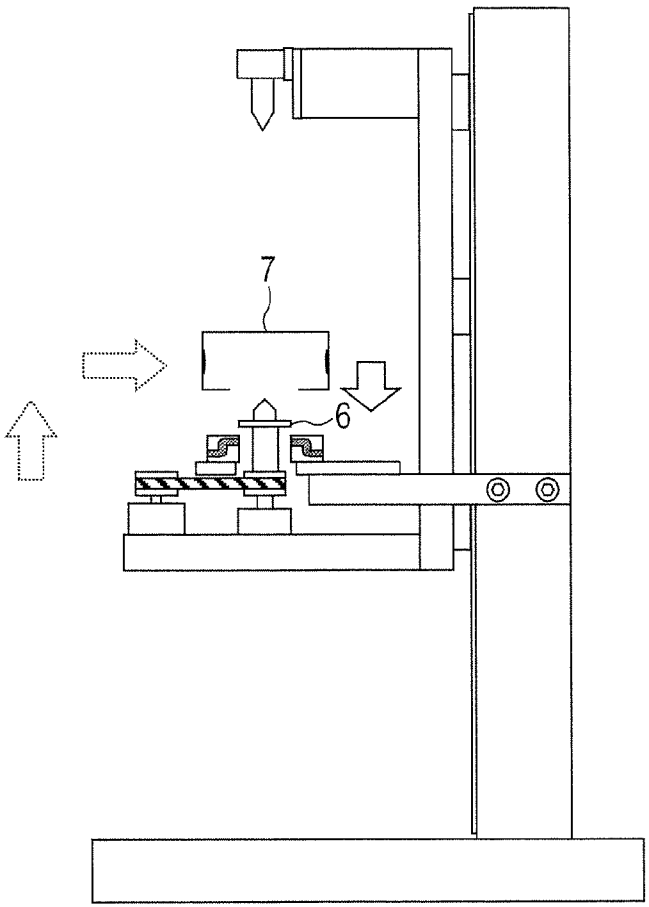
Figure 2E:
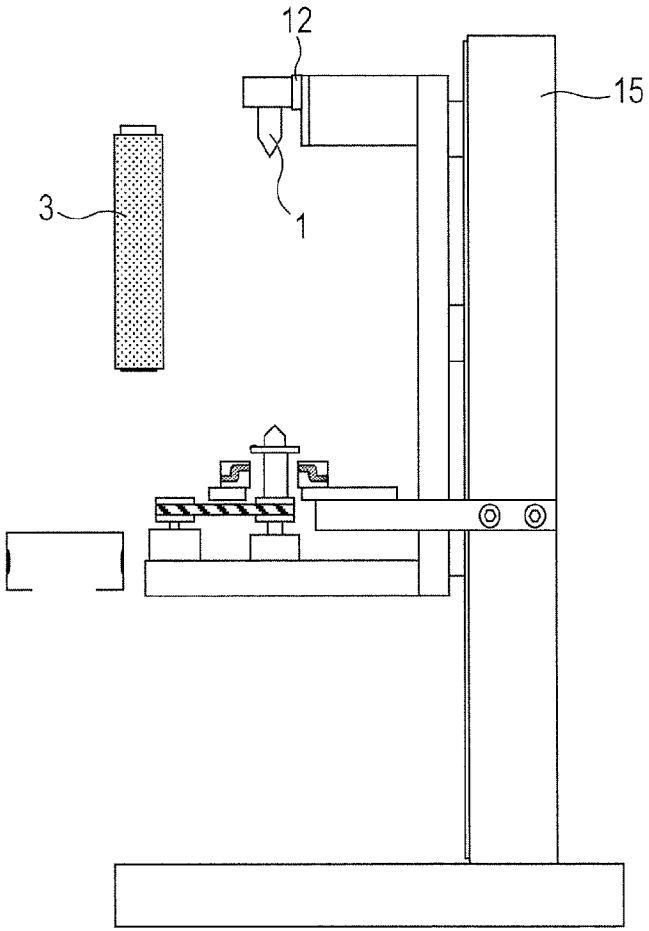

The upper holding shaft 1 is moved up by the upper holding shaft slide portion 12, and the mandrel 3 after quantitative coating is taken out from the coating device 15 by the attachment and detachment device (not shown) (FIG. 2E).

In order to collect the coating liquid 14 transferred to the cleaning blade 6, the collection container 7 is moved above the cleaning blade 6 (FIG. 2F).

Figure 2H:
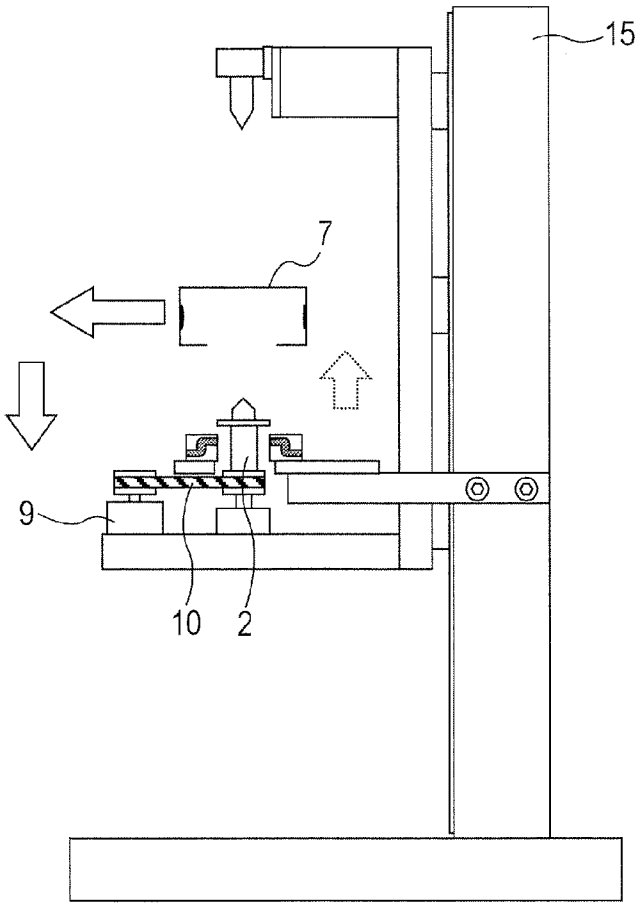
Figure 2G:
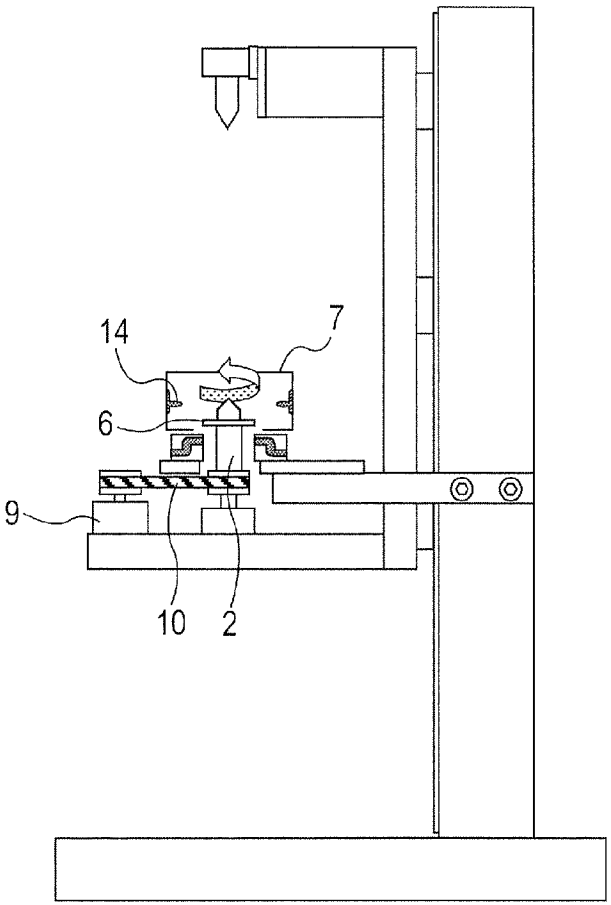

The collection container 7 is moved down, the lower holding shaft 2 is inserted through the opening into the collection container 7, so that the collection container 7 covers the cleaning blade 6. In this state, the rotary drive source 9 coupled to the lower holding shaft 2 is driven to rotate the lower holding shaft 2 via the rotation transmitting belt 10. The coating liquid 14 transferred to the cleaning blade 6 is dispersed in the collection container 7 by the centrifugal force generated by the rotation and collected (FIG. 2G).

The rotary drive source 9 is stopped to stop the rotation of the lower holding shaft 2 coupled by the rotation transmitting belt 10. Then, the collection container 7 is moved above the lower holding shaft 2, and further moved to a predetermined position in the coating device 15 (FIG. 2H).

Figure 2I:
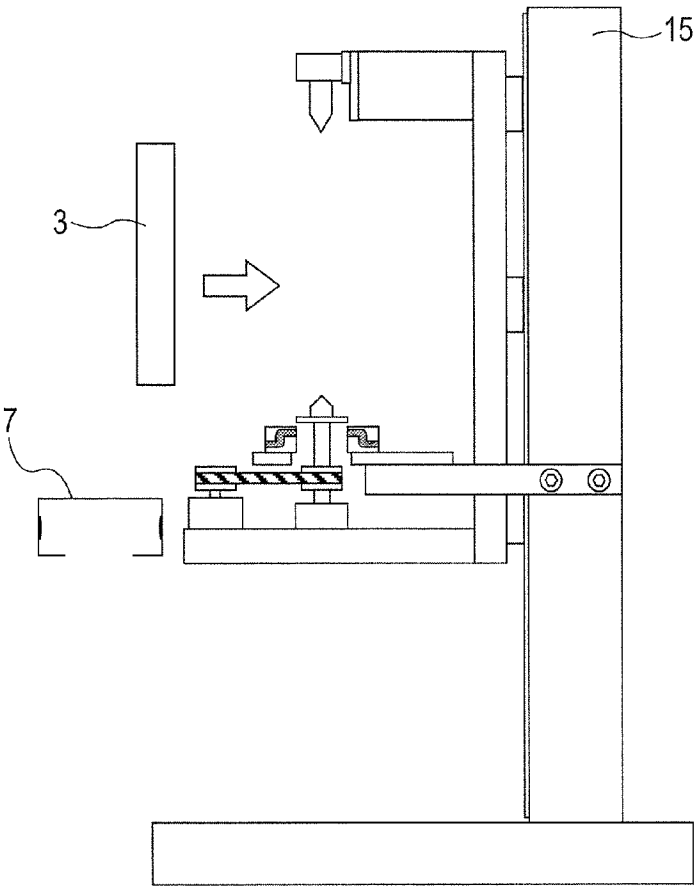

When the collection container 7 reaches the predetermined position in the coating device 15, the coating device 15 is placed on standby until the attachment and detachment device (not shown) carries a next mandrel 3 to be coated (FIG. 2I).

Thereafter, the above described operations illustrated in FIGS. 2A to 2I can be sequentially repeated to obtain a plurality of cylindrical members.

Embodiment 2

A second method for coating the mandrel 3 using the coating device 15 in FIG. 1 will be described. In this method, the collection container 7 is moved below the ring-shaped coating head 5. FIGS. 3A to 3I schematically show a flow of a series of coating operations in this embodiment.

The mandrel slide mechanism 11 is moved to an upper end, and the upper holding shaft 1 is moved up by the upper holding shaft slide portion 12, the cylinder (not shown), and the servomotor (not shown). Then, a lower end of the mandrel 3 is held on the lower holding shaft 2 by an attachment and detachment mechanism (not shown), then the upper holding shaft 3 is moved down by the upper holding shaft slide portion 12, the cylinder (not shown), and the servomotor (not shown), and the mandrel 3 is held between the upper holding shaft 1 and the lower holding shaft 2 and secured (FIG. 3A).

Figure 3B:
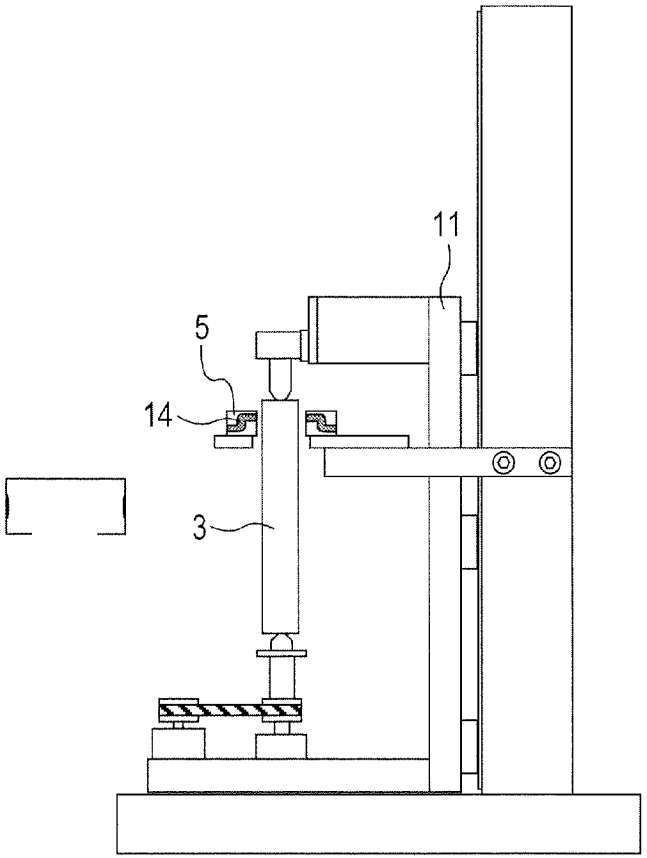
FIGS. 3A, 3B, 3C, 3D, 3E, 3F, 3G, 3H and 3I illustrate coating operations according to Embodiment 2.
Figure 3A:
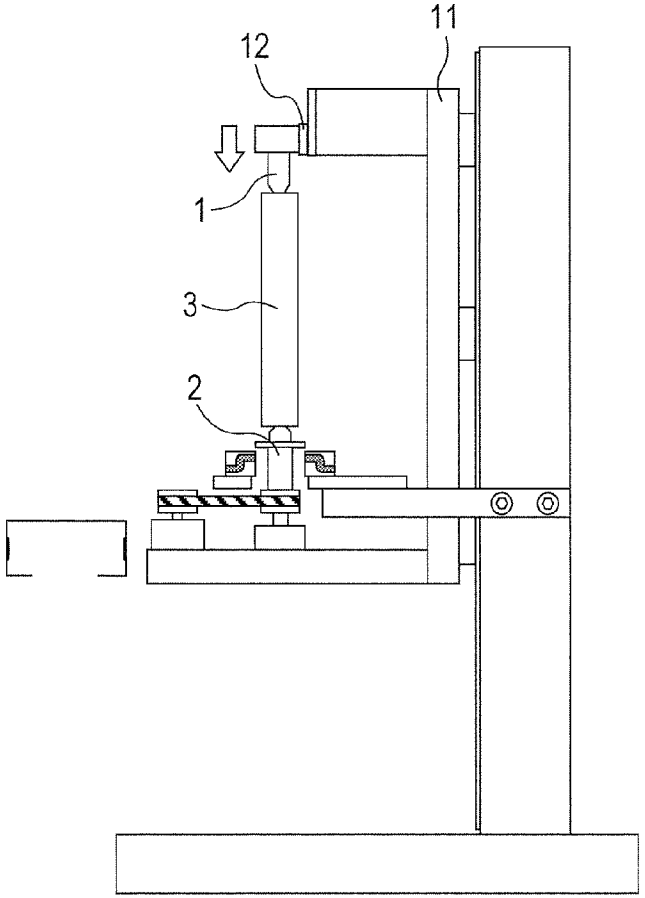

The mandrel slide mechanism 11 is moved down to match a coating start position of the mandrel 3 with a discharge position of the coating liquid 14 of the ring-shaped coating head 5 (FIG. 3B).

Figure 3D:
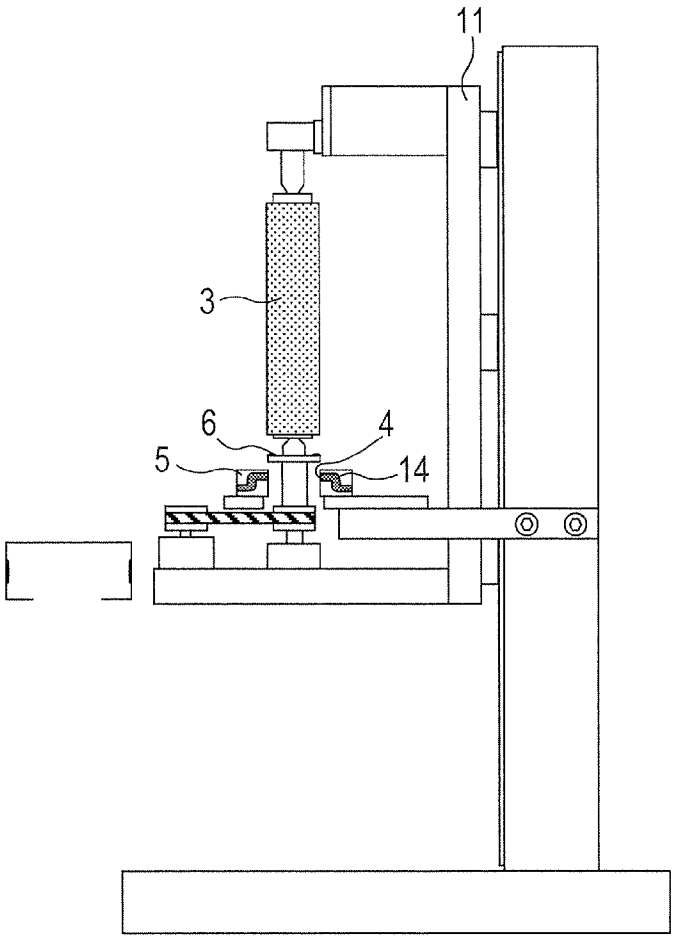
Figure 3C:
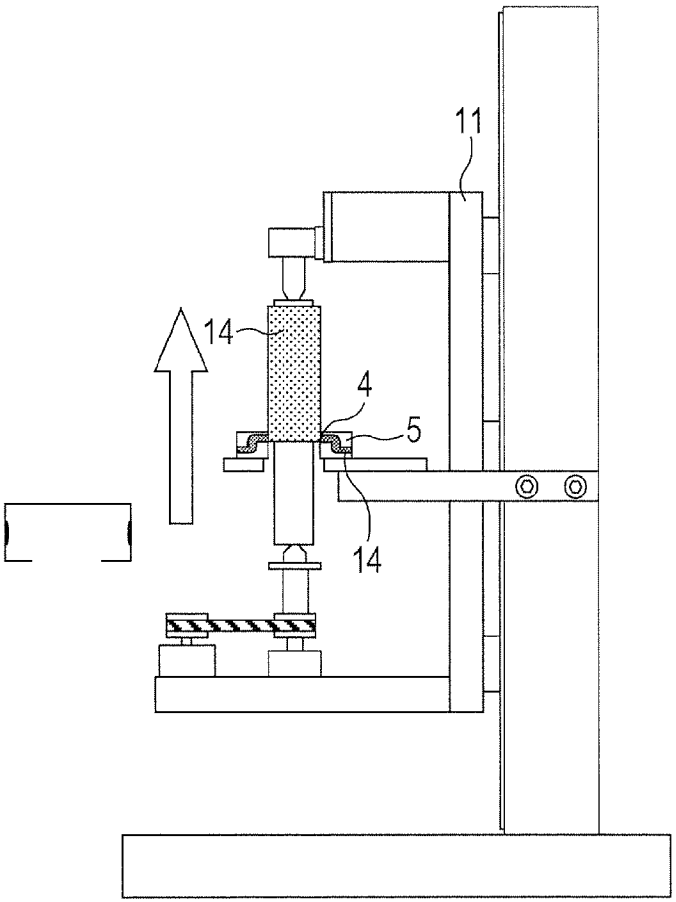

While the coating liquid 14 is discharged at a constant flow rate from the ring-shaped coating head 5 through the annular slit 4 toward the outer peripheral surface of the mandrel 3, the mandrel slide mechanism 11 is moved up at a constant speed, so that a coating having a constant thickness is formed on the outer peripheral surface of the mandrel 3 (FIG. 3C).

After coating to a coating finish position on the mandrel 3, discharge of the coating liquid 14 through the annular slit 4 is stopped. The mandrel slide mechanism 11 is further moved up to move the cleaning blade 6 above the ring-shaped coating head 5 (FIG. 3D). The cleaning blade 6 passes through a position of the annular slit 4, and thus the coating liquid 14 generated during when discharge of the coating liquid 14 is stopped and remaining on around the annular slit 4 can be scraped off by an upper surface of the cleaning blade 6 and transferred to the upper surface.

Figure 3F:
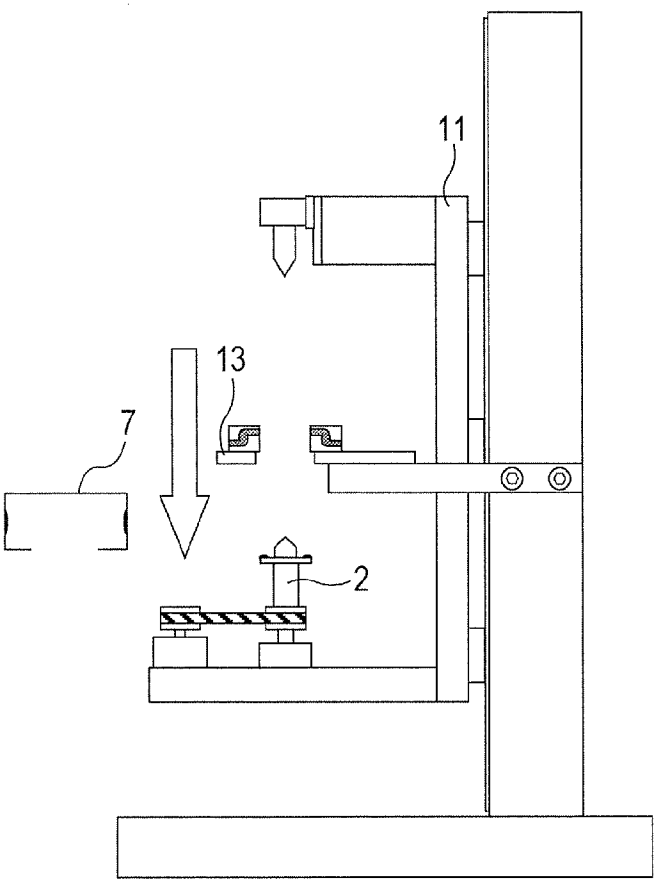
Figure 3E:
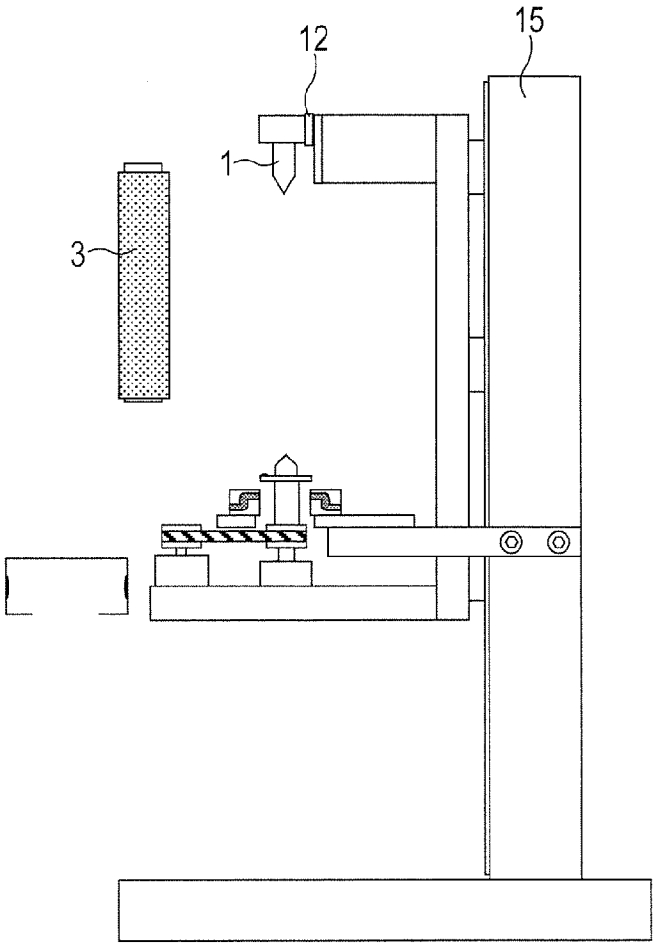
Figure 3H:
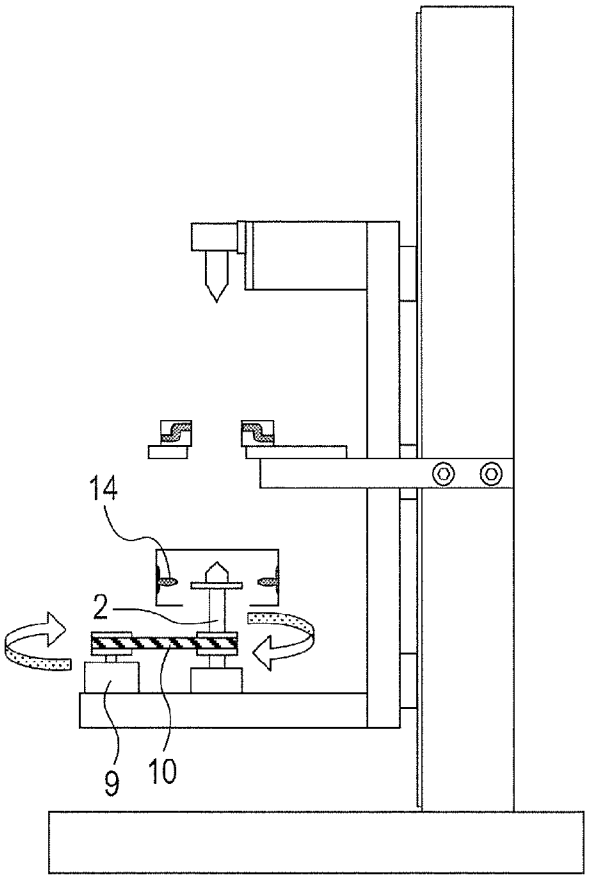

The upper holding shaft 1 is moved up by the upper holding shaft slide portion 12, and the mandrel 3 after quantitative coating is taken out from the coating device 15 by the attachment and detachment device (not shown) (FIG. 3E).

Then, the mandrel slide mechanism 11 is moved down at a constant speed to a position where the collection container 7 can be placed between the coating head stage 13 and the lower holding shaft 2 (FIG. 3F). At this time, the cleaning blade 6 passes through the position of the annular slit 4, and thus the coating liquid 14 remaining on around the annular slit 4 can be again scraped off by a lower surface of the cleaning blade 6 and transferred to the lower surface.

Figure 3G:
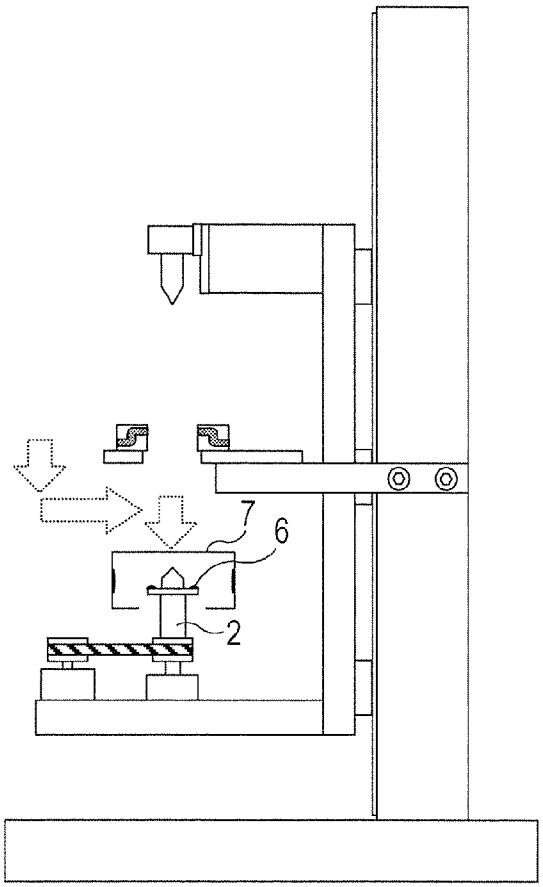

In order to collect the coating liquid 14 transferred to the opposite surfaces of the cleaning blade 6, the collection container 7 is moved above the lower holding shaft 2. Then, the collection container 7 is moved down, the lower holding shaft 2 is inserted through the opening into the collection container 7, so that the collection container 7 covers the cleaning blade 6 (FIG. 3G).

The rotary drive source 9 coupled to the lower holding shaft 2 is driven to rotate the lower holding shaft 2 via the rotation transmitting belt 10. The coating liquid 14 transferred to the cleaning blade 6 is dispersed in the collection container 7 by the centrifugal force generated by the rotation and collected (see FIG. 3H).

Figure 3I:
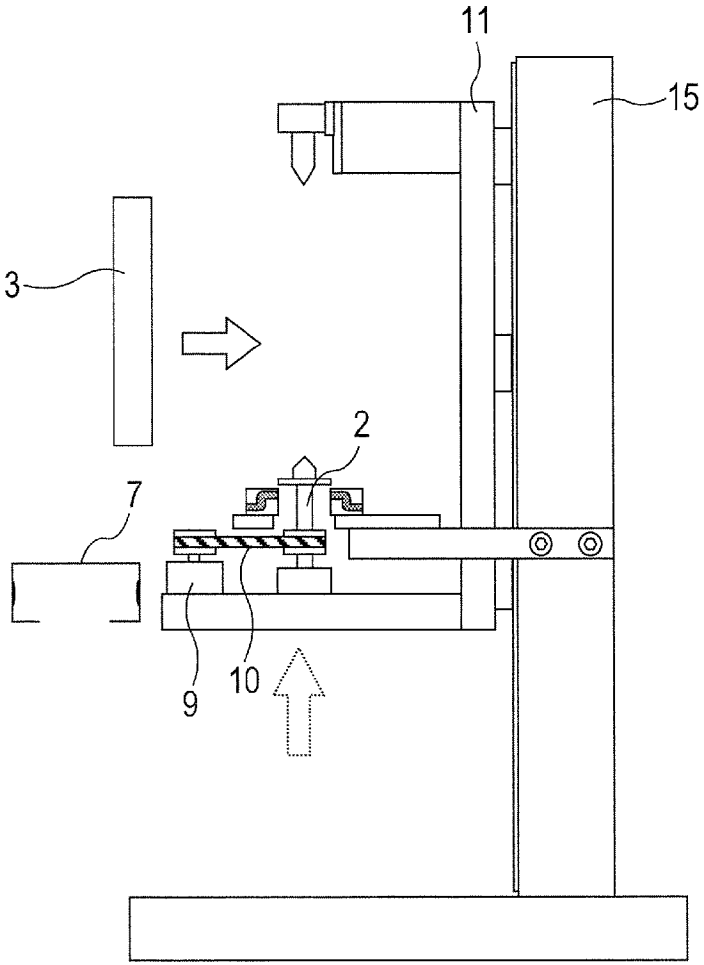

The rotary drive source 9 is stopped to stop the rotation of the lower holding shaft 2 coupled by the rotation transmitting belt 10. Then, the collection container 7 is moved above the lower holding shaft 2, and further moved to a predetermined position in the coating device 15. When the collection container 7 is moved to the predetermined position, the mandrel slide mechanism 11 is moved up, and the coating device 15 is placed on standby until the attachment and detachment device (not shown) carries a next mandrel 3 to be coated (FIG. 3I).

Thereafter, the above described operations illustrated in FIGS. 3A to 3I are repeated.

In the coating method of the present invention, one of Embodiments 1 and 2 described above may be performed, but not limited to this. Specifically, the collection container 7 may cover the cleaning blade 6 both above and below the ring-shaped coating head 5 to clean the cleaning blade 6.

Next, it was checked whether a relationship between diameters of the ring-shaped coating head 5 and the cleaning blade 6 would influence a cleaning effect of the inner peripheral surface of the ring-shaped coating head 5 by the cleaning blade 6. Specific conditions are as described below. An inner diameter of the ring-shaped coating head 5 was 18.0 mm, and the cleaning blade 6 made of silicone rubber was used. In the present invention, a cleaning blade containing, for example, one or two or more selected from the group consisting of urethane rubber, butyl rubber, fluororubber, and silicone rubber is favorably used. A thickness of the cleaning blade 6 was 2.0 mm. An outer diameter of the cleaning blade 6 was varied between 18.0 to 21.0 mm. As the coating liquid 14, a silicone rubber mixture was used, and a weight average of the coating liquid 14 remaining outside the annular slit 4 of the ring-shaped coating head 5 was 0.05 g. Consequently, when the inner diameter of the ring-shaped coating head 5 was 18.0 mm and the outer diameter of the circular cleaning blade was 19.0 mm, a most satisfactory cleaning effect was obtained.

FIGS. 4A to 4L illustrate an aspect of operations of the cleaning blade 6 in a cleaning step of the inner peripheral surface of the ring-shaped coating head 5 in Embodiment 2. FIGS. 4A to 4F illustrate operations in a case of using a cleaning blade 6 having an outer diameter equal to an inner diameter of the ring-shaped coating head 5.

Figure 4A:
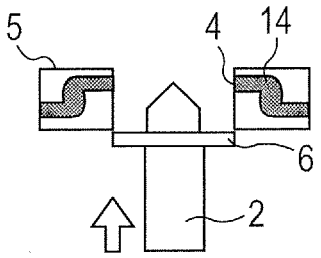
FIGS. 4A, 4B, 4C, 4D, 4E and 4F illustrate an aspect of operations of a cleaning blade according to Embodiment 2.

First, as illustrated in FIG. 4A, a state where the inner diameter of the ring-shaped coating head 5 is equal to the outer diameter of the cleaning blade 6 will be described.

Figure 4D:
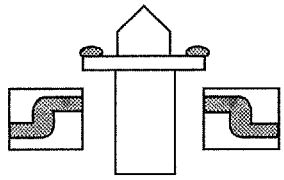
Figure 4B:
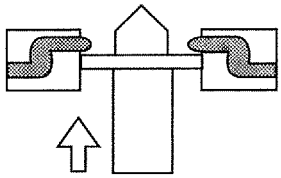

Even if discharge of the coating liquid 14 through the annular slit 4 is stopped, the coating liquid is forced out through the annular slit 4 by residual pressure in a nozzle of the ring-shaped coating head 5, while the lower holding shaft 2 is moved up (FIG. 4B).

Figure 4E:
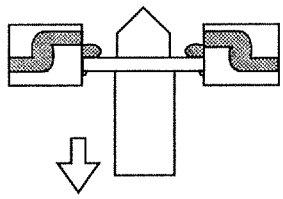
Figure 4C:
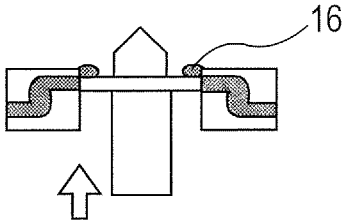

The lower holding shaft 2 is further moved up, the cleaning blade 6 passes through the annular slit 4, and the coating liquid 14 forced out through the annular slit 4 is scraped off by the upper surface of the cleaning blade 6 and transferred to the upper surface (FIG. 4C).

When the cleaning blade 6 reaches above the ring-shaped coating head 5, upward movement of the lower holding shaft 2 is stopped (FIG. 4D). This state corresponds to a state when the quantitative coating of the coating liquid 14 is finished and immediately before the mandrel 3 after coating is taken out from the coating device 15, illustrated in FIG. 3D.

The lower holding shaft 2 is moved down, the cleaning blade 6 again passes through the annular slit 4, and the coating liquid 14 forced out through the annular slit 4 is scraped off by the lower surface of the cleaning blade 6 to be cleaned (FIG. 4E).

Figure 4F:
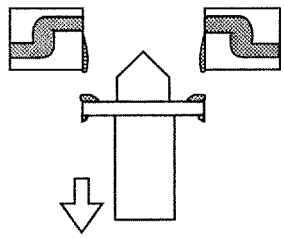

The lower holding shaft 2 is further moved down, and the cleaning blade 6 is located below the ring-shaped coating head 5 (FIG. 4F).

Next, FIGS. 4G to 4L illustrate another aspect of operations of the cleaning blade 6 in the cleaning step of the inner peripheral surface of the ring-shaped coating head 5 in Embodiment 2. The cleaning blade 6 used herein has an outer diameter larger than an inner diameter of the ring-shaped coating head 5.

Figure 4G:
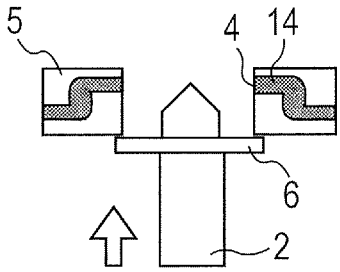
FIGS. 4G, 4H, 4I, 4J, 4K and 4L illustrate another aspect of operations of the cleaning blade according to Embodiment 2.

Even if discharge of the coating liquid 14 through the annular slit 4 is stopped, the coating liquid 14 is forced out through the annular slit 4 by residual pressure in a nozzle of the ring-shaped coating head 5. In this state, while the lower holding shaft 2 is moved up, since the outer diameter of the cleaning blade 6 is larger than the inner diameter of the ring-shaped coating head 5, an outer peripheral portion of the cleaning blade 6 is curved downward (FIG. 4G, FIG. 4H).

Figure 4J:
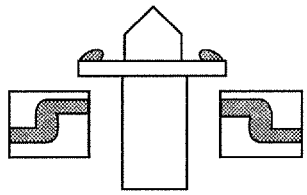
Figure 4H:
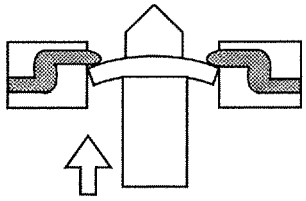
Figure 4K:
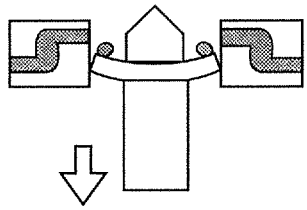
Figure 4I:
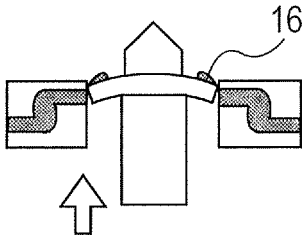

The lower holding shaft 2 is further moved up, the cleaning blade 6 passes through the annular slit 4, and the coating liquid 14 forced out through the annular slit 4 is scraped off by the upper surface of the cleaning blade 6 and transferred to the upper surface (FIG. 4I).

When the cleaning blade 6 reaches above the ring-shaped coating head 5, upward movement of the lower holding shaft 2 is stopped (FIG. 4J). This state corresponds to a state when the quantitative coating of the coating liquid 14 is finished and immediately before the mandrel 3 after coating is taken out from the coating device 15, illustrated in FIG. 3D.

The lower holding shaft 2 is moved down, the cleaning blade 6 again passes through the annular slit 4, and the coating liquid 14 forced out through the annular slit 4 is scraped off by the lower surface of the cleaning blade 6 (FIG. 4K). At this time, since the outer diameter of the cleaning blade 6 is larger than the inner diameter of the ring-shaped coating head 5, the outer peripheral portion of the cleaning blade 6 is curved upward. Specifically, since the cleaning blade 6 is recessed downward, the coating 16 transferred to the upper surface of the cleaning blade 6 does not come into contact with the coating liquid 14 on the surface of the annular slit 4 during downward movement of the lower holding shaft 2.

Figure 4L:
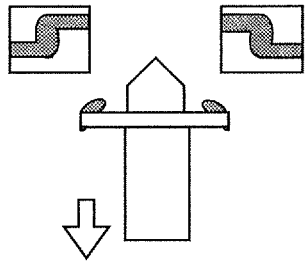

The holding shaft 2 is further moved down, and the cleaning blade 6 is located below the ring-shaped coating head 5 (FIG. 4L). As such, when the cleaning blade 6 again passes through the annular slit 4, the coating 16 transferred to the upper surface of the cleaning blade 6 can be reliably prevented from re-adhering to the inner peripheral surface of the ring-shaped coating head 5. Specifically, the aspect illustrated in FIGS. 4G to 4L can be used to more reliably clean the inner peripheral surface of the ring-shaped coating head 5. As illustrated in FIGS. 4G to 4L, when the diameter of the cleaning blade is larger than the inner diameter of the ring-shaped coating head, the cleaning blade is preferably made of a more elastic material. Specifically, a cleaning blade made of silicone rubber is favorably used.

Next, a removal effect of the coating 16 adhering to the cleaning blade 6 by the centrifugal force of the cleaning blade 6 was checked.

First, a rotation speed of the cleaning blade 6 suitable for dispersing the coating 16 transferred to the cleaning blade 6 was checked. As test conditions, the inner diameter of the ring-shaped coating head was 18.0 mm, the cleaning blade 6 was made of silicone rubber, having an outer diameter of 19.0 mm and a thickness of 2.0 mm. As the coating liquid 14, a silicone rubber mixture was used, and a weight average of the coating liquid 14 remaining outside the annular slit 4 of the ring-shaped coating head 5 was 0.05 g. A rotation speed of the cleaning blade 6 was 4000 to 8000 rpm, and the rotation time was 5 seconds.

As a result, at the rotation speed of 8000 rpm, the coating 16 adhering to the cleaning blade 6 was able to be more satisfactorily dispersed.

Next, based on the above described result, an optimum rotation time at the rotation speed of 8000 rpm was checked. The rotation speed of the cleaning blade 6 was 8000 rpm and the rotation time was 2 to 6 seconds.

Other test conditions are the same as described above. As a result, when the rotation time is 4 seconds or longer, the coating 16 adhering to the cleaning blade 6 was able to be more satisfactorily dispersed.

Based on the test results described above, if the inner diameter of the ring-shaped coating head 5 is 18.0 mm, the cleaning blade 6 is made of silicone rubber, and the thickness is 2.0 mm, a condition for efficiently cleaning the ring-shaped coating head 5 is as described below.

The diameter of the cleaning blade 6 is 19.0 mm, the rotation speed is 8000 rpm, and the rotation time is 4 seconds or longer.

As described above, in the coating method of the present invention, the cleaning blade 6 can be used to clean the inner peripheral surface of the ring-shaped coating head 5 having the annular slit 4. Unlike conventional techniques, a component for cleaning can be reused without being changed for each use. Thus the needs to prepare multiple detachable ring members or to provide a mechanism for attaching and detaching the ring members as in the conventional techniques can be eliminated, and increase in cost and the number of coating steps and further an increase in size of the coating device can be prevented.

If a size and a shape of the outer diameter of the cleaning blade 6 are selected, the cleaning blade 6 can be used for a discharge head on a plane, a ring head having an opening directed inside, and a ring head having an opening directed outside.

Further, by selecting the material of the cleaning blade 6, the cleaning blade 6 can be adopted to types of coatings having low or high viscosity.

In Embodiments 1 and 2 described above, as described with reference to FIGS. 1 to 3I, the cleaning blade 6 secured to the lower holding shaft 2 of the coating device 15 is rotated by rotating the lower holding shaft 2 via the rotation transmitting belt 10 using a drive force from the rotary drive source 9.

As another aspect of rotating the cleaning blade 6, a method of directly connecting the rotary drive source 9 immediately below the lower holding shaft 2 and directly rotating the lower holding shaft 2 to rotate the cleaning blade 6 will be described with reference to FIG. 5.

Figure 5:
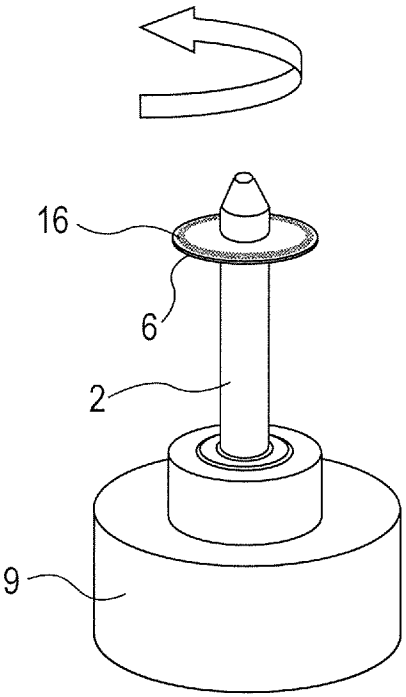
FIG. 5 is a schematic perspective view illustrating a configuration in which a lower holding shaft is directly connected to a rotation axis of a rotary drive source.

FIG. 5 is a schematic perspective view illustrating a configuration in which the rotary drive source 9 is directly connected immediately below the lower holding shaft 2. The rotary drive source 9 in this embodiment may use an electric motor or fluid rotation. FIG. 5 illustrates an example of a spindle motor.

The lower holding shaft 2 is directly rotationally driven by the rotary drive source 9 placed immediately below the lower holding shaft 2, thus it can smoothly rotate without axial runout.

If the cleaning blade 6 is secured to an upper part of the lower holding shaft 2. As the rotation speed is increased, the coating 16 transferred to the cleaning blade 6 is dispersed from the cleaning blade 6 by a centrifugal force.

In this embodiment, the rotary drive source 9 is directly connected to the lower holding shaft 2, and the rotary drive source 9 is placed immediately below the lower holding shaft 2, thereby saving space of the coating device 15.

Figure 6:
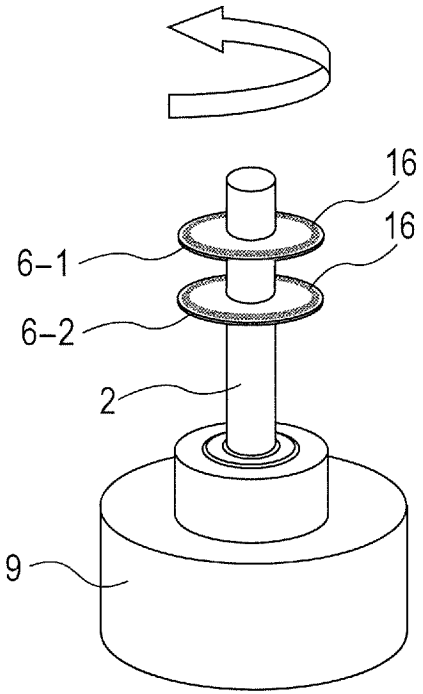
FIG. 6 is a schematic perspective view illustrating a rotary drive source, and a lower holding shaft directly connected to a rotation axis of the rotary drive source and having two cleaning blades secured thereto.

In Embodiments 1 and 2, one cleaning blade 6 is secured to the lower holding shaft 2. Alternatively, if one cleaning blade 6 is insufficient for transferring the coating liquid 14 remaining on the inner peripheral surface of the coating head 5, such as when a thick coating is formed on the mandrel or when the coating liquid 14 has high viscosity, a plurality of cleaning blades 6-1 and 6-2 may be secured to the lower holding shaft 2 as illustrated in FIG. 6. In FIG. 6, the lower holding shaft 2 is directly connected to the rotary drive source 9 immediately below the lower holding shaft 2 as in Embodiment 2.

With such a configuration, the coating liquid 14 that has not been transferred to the cleaning blade 6-1 when the first cleaning blade 6-1 as a first one of the cleaning blade 6 passes through the annular slit 4 can be transferred to the second cleaning blade 6-2 as a second one of the cleaning blade 6, thereby providing a greater cleaning effect of the inner peripheral surface of the ring-shaped coating head. This can more effectively lessen the coating liquid 14 remaining on the annular slit 4 opening in the inner peripheral surface of the ring-shaped coating head 5.

The two cleaning blades 6-1 and 6-2 are secured to the lower holding shaft 2 so that central axes of the cleaning blades 6-1 and 6-2 are coaxial with the central axis of the lower holding shaft 2.

The lower holding shaft 2 and the cleaning blade 6 are adjusted by a component of a position adjustment mechanism (not shown) to be coaxial with the central axis of the ring-shaped coating head 5 having the annular slit 4 opening therein.

The cleaning blades 6-1 and 6-2 do not need to have the same thickness. Three or more cleaning blades may be used.

According to the present invention, the cleaning member configured to clean the inner peripheral surface of the ring-shaped coating head can be repeatedly used, thereby further reducing manufacturing cost of the cylindrical member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-266881, filed Dec. 6, 2011, and No. 2012-250520, filed Nov. 14, 2012 which are hereby incorporated by reference herein in their entirety.

What is claimed is:

1. A method for manufacturing a cylindrical member which comprises a mandrel and a coating formed on the peripheral surface thereof, the method comprising a step of:

vertically or substantially vertically holding a mandrel with an upper holding shaft and a lower holding shaft so as to be coaxial with a central axis of a ring-shaped coating head having an annular slit opening in an inner peripheral surface, and discharging a coating liquid through the annular slit while vertically or substantially vertically moving up the mandrel with respect to the ring-shaped coating head to form the coating on an outer peripheral surface of the mandrel, wherein a circular cleaning blade is rotatably mounted around the lower holding shaft, wherein the step includes the steps of:

(1) forming the coating of the coating liquid up to a lower end of a coating region on the outer peripheral surface of the mandrel, and then stopping discharge of the coating liquid through the annular slit;

(2) moving up the lower holding shaft with respect to the ring-shaped coating head so that the cleaning blade passes through the annular slit to clean the annular slit; and (3) moving down the lower holding shaft with respect to the ring-shaped coating head so that the cleaning blade passes through the annular slit to clean the annular slit; in this order, and wherein the method further comprises a step of rotating the cleaning blade around the lower holding shaft to clean the cleaning blade after at least one of the steps (2) and (3).

2. The method according to claim 1, wherein in the step of cleaning the cleaning blade, the lower holding shaft is rotated with a collection container covering the cleaning blade.

3. The method according to claim 1, wherein a plurality of cleaning blades are secured to the lower holding shaft.

4. The method according to claim 1, wherein a diameter of the cleaning blade is larger than an inner diameter of the ring-shaped coating head.

5. The method according to claim 1, wherein the cleaning blade is made of an elastic material.

6. The method according to claim 1, wherein the cleaning blade contains one or two or more rubbers selected from the group consisting of urethane rubber, butyl rubber, fluororubber, and silicone rubber.

7. The method according to claim 1, wherein the lower holding shaft is associated with a rotation axis of a rotary drive source and via a belt.

8. The method according to claim 1, wherein the cylindrical member is an elastic roller used in an electrophotographic apparatus.

9. A method for manufacturing a cylindrical member which comprises a mandrel and a coating formed on a peripheral surface thereof, the method comprising a step of:

vertically or substantially vertically holding a mandrel with an upper holding shaft and a lower holding shaft so as to be coaxial with a central axis of a ring-shaped coating head having an annular slit opening in an inner peripheral surface, and discharging a coating liquid through the annular slit while vertically or substantially vertically moving up the mandrel with respect to the ring-shaped coating head to form a coating of the coating liquid on an outer peripheral surface of the mandrel, wherein a circular cleaning blade is rotatably mounted around the lower holding shaft, wherein the step includes the steps of:

(1) forming the coating of the coating liquid up to a lower end of a coating region on the outer peripheral surface of the mandrel, and then stopping discharge of the coating liquid through the annular slit; and (2) moving up the lower holding shaft with respect to the ring-shaped coating head so that the cleaning blade passes through the annular slit to clean the annular slit; in this order, and wherein the method further comprises a step of rotating the cleaning blade around the lower holding shaft to clean the cleaning blade after the step (2).

* * * * *